United States Patent [19]

Laurita

[11] 4,333,179

[45] Jun. 8, 1982

[54] PROTECTIVE GUARD FOR THE THROAT AREA

[76] Inventor: Robert A. Laurita, 105-00 Shore Front Pkwy., Apt. 6-L, Rockaway, N.Y. 11694

[21] Appl. No.: 160,834

[22] Filed: Jun. 18, 1980

[51] Int. Cl.[3] ..... A41D 13/00; A42B 3/02

[52] U.S. Cl. ..... 2/2; 2/9; 2/413; 2/DIG. 6

[58] Field of Search ..... 2/2, 9, 413, DIG. 6, 2/2 R

[56] References Cited

U.S. PATENT DOCUMENTS

| | | | |
|---|---|---|---|
| 376,278 | 1/1888 | Barnard | 2/9 |
| 802,505 | 10/1905 | Goldsmith | 2/9 |
| 3,041,623 | 7/1962 | Glahe | 2/9 |
| 3,070,090 | 12/1962 | Taylor | 2/DIG. 6 |
| 4,274,161 | 6/1981 | Littler | 2/413 |

FOREIGN PATENT DOCUMENTS

| | | | |
|---|---|---|---|
| 680426 | 8/1939 | Fed. Rep. of Germany | 2/2 R |

*Primary Examiner*—Louis Rimrodt
*Attorney, Agent, or Firm*—Richard L. Miller

[57] ABSTRACT

A neck collar having a guard at its front for shielding the throat area from any violent striking force thereagainst; the guard including an air-inflated padding which upon its front side is shielded by a metal grill.

1 Claim, 4 Drawing Figures

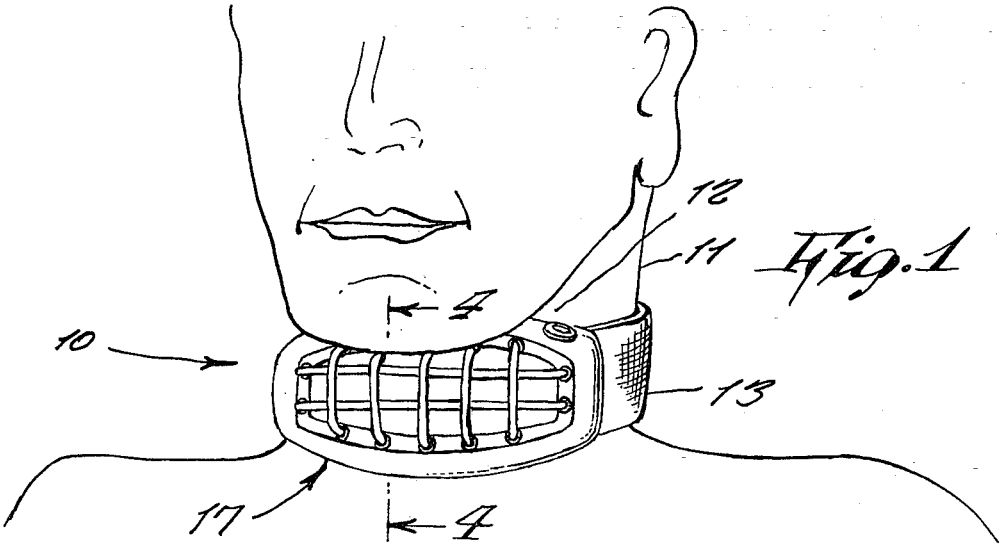
Fig. 1
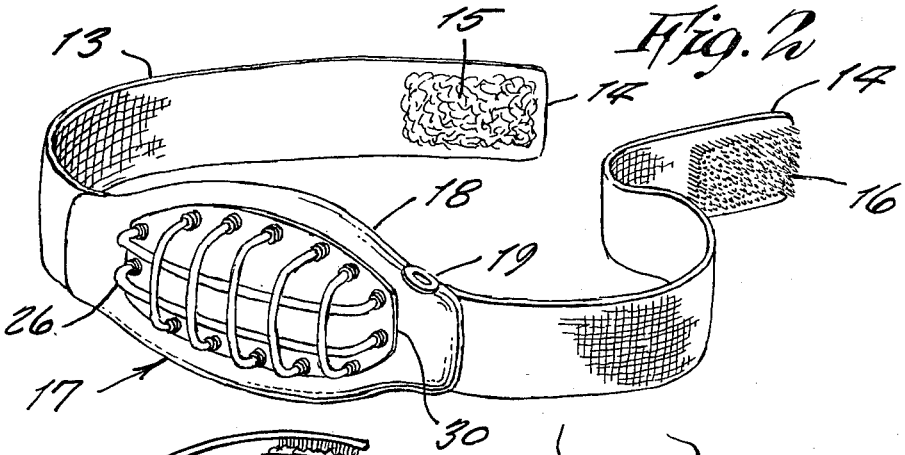
Fig. 2
Fig. 3
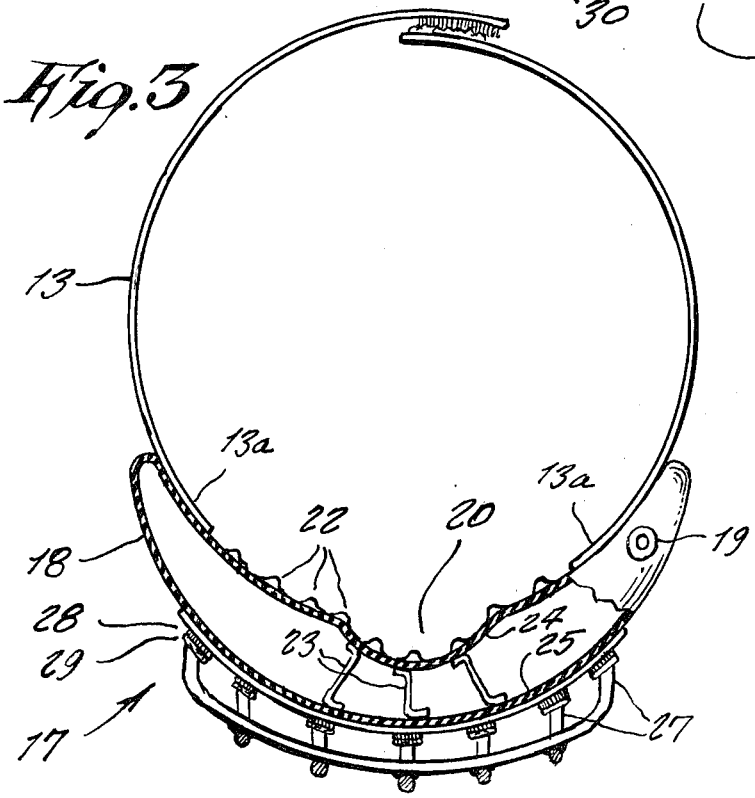
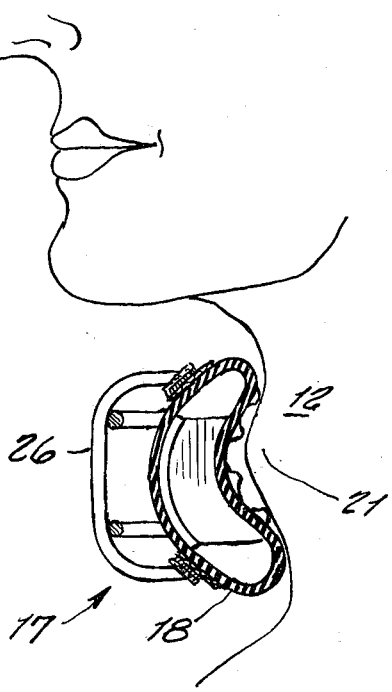
Fig. 4

PROTECTIVE GUARD FOR THE THROAT AREA

BACKGROUND OF THE INVENTION

This invention relates generally to body guard devices.

It is well known that a violent striking force against a person's throat area is very serious and is possible, in some instances, to be fatal. Some persons are more liable for such violent striking force to be inflicted against them; such as baseball catchers who may be struck by a swinging bat, or players in other physically violent force such as football players and the like. Also police on riot duty who are subject to being struck by clubs are in such danger.

This situation is accordingly in need of protective improvement.

SUMMARY OF THE INVENTION

Therefore it is a principal object of the present invention, to provide a guard for being worn by a person who is exposed to any danger of being struck by any object against his throat area.

Another object is to provide a protective guard for the throat area, wherein protective grill is selectively removable so that the device may be used either with only an air-inflated padding or else also with the grill, depending upon the amount of protection that is needed.

Further objects of the invention will appear as the description proceeds.

To the accomplishment of the above and related objects, this invention may be embodied in the form illustrated in the accompany drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a front perspective view of the invention shown being worn around a person's neck.

FIG. 2 is a front perspective view thereof, shown removed.

FIG. 3 is a top view of the device shown partly in cross section.

FIG. 4 is an enlarged cross sectional view taken on line 4—4 of FIG. 1.

Referring now to the drawing in greater detail, the reference numeral 10 represents a protective guard according to the present invention, and which is used for wear around a person's neck 11 so as to shield a throat area 12 thereof from any hard blow thereagainst, such as from a club, a hard ball, an opponent's foot, or the like, which may be made willfully or accidentally.

The guard includes a collar 13 for fitting around the neck and which at opposite rear ends 14 is adjustably attached together in a quick and easy manner by means of Velcro members 15 and 16.

A shield 17 formed between front ends 13*a* of the collar includes a soft, inflatable air bag 18 which is affixed to the outer side of the collar. An air valve 19 allows easy inflation of the air bag which is made either out of plastic or rubber. As clearly shown in FIGS. 3 and 4, the air bag is contoured with a forwardly cupped depression 20 so as to clear the Adam's apple 21 of a wearer, and that the device is fully comfortable without pressure thereagainst. Additionally, as shown in the same figures, a plurality of small bumps 22 are formed on the surface of the air bag which abuts against the neck, for also a same reason of comfort by giving roominess therebetween. The contoured depression is maintained, even when the air bag is inflated, by means of a plurality of radiating straps 23 secured between opposite inner and outer walls 24 and 25 of the air bag.

The air valve on the air bag for inflating the air bag, may be either re-inflatable or else the bag may be permanently blown up without a valve.

The shield 17 also includes a selectively detachable, cage-like grill 26 made of stiff steel wires welded together and coated with a rubber on its outer side. The ends 27 of the wires are bent toward the air bag and a loop pile member 29, affixed on the tip of each wire end, is attachable to a loop pile member 28, carried by the bag. In order to prevent the grill from puncturing the inflated air bag, when the grill is struck a hard blow, a tough reinforcement pad 30 made of canvas or the like, is permanently adhered on the front side of the bag on which the loop pile members 29 are affixed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A protective guard for a throat area, comprising in combination, a collar for being worn around a neck, and a shield at a front of said collar, said shield comprising an air bag on said collar, and a grill on a front side of said air bag; said grill being selectively detachable from said air bag by loop pile fastener means; said air bag being contoured to fit around an Adam's apple portion of said throat by means of a plurality of radiating straps between opposite inner and outer walls of said air bag so to maintain a contour for said Adam's apple.

* * * * *